US005118212A

United States Patent [19]

Shao

[11] Patent Number: 5,118,212

[45] Date of Patent: Jun. 2, 1992

[54] WRITING UTENSIL WITH INTEGRAL STAMPING EQUIPMENT

[75] Inventor: Hsing-Chuan Shao, Taipei, Taiwan

[73] Assignee: Nice-Green Enterprise Co., Ltd., Taipei, Taiwan

[21] Appl. No.: 796,472

[22] Filed: Nov. 22, 1991

[51] Int. Cl.[5] ..... B43K 29/00

[52] U.S. Cl. ..... 401/195; 101/333

[58] Field of Search ..... 401/195; 101/333

[56] References Cited

U.S. PATENT DOCUMENTS 3,438,716 4/1969 Peters ..... 401/195

FOREIGN PATENT DOCUMENTS 8418819 5/1985 Fed. Rep. of Germany ..... 401/195

*Primary Examiner*—Steven A. Bratlie

*Attorney, Agent, or Firm*—Christensen, O'Connor, Johnson & Kindness

[57] ABSTRACT

A stamping equipment of a writing utensil includes a stamp pad support extending from the rear end of the writing utensil. An elongated recessed groove is formed on the stamp pad support. A stamp support that includes a first end pivoted about the rear end of the writing utensil to pivot between a first position parallel to the longitudinal axis of the writing utensil and a second position perpendicular to the longitudinal axis of the writing utensil. A stamp plate with a seal on one side and a stud with a considerable weight on the other side, which is eccentrically pivoted about the other end of the stamp support to pivot between a third position parallel to the longitudinal axis of the writing utensil and a fourth position perpendicular to the longitudinal axis of the writing utensil. A slidable cap of the writing utensil can enclose the stamping equipment within the same.

3 Claims, 3 Drawing Sheets

WRITING UTENSIL WITH INTEGRAL STAMPING EQUIPMENT

BACKGROUND OF THE INVENTION

1. Field of Invention

This invention relates to a writing utensil, more particularly to a ball-point pen having integral stamping equipment. The equipment includes a stamp pivotally mounted on a support which is again pivotally mounted on the rear end of the writing utensil. The stamp and stamp support are automatically enclosed within a slidable cap of the writing utensil when the stamp and stamp support are positioned parallel to the longitudinal axis of the writing utensil.

2. Description of the Related Art

Known writing utensils with integral stamping equipment includes two basic constructions.

In one such construction, a stamp support with a stamp plate disposed upon a stamp pad is loosely inserted in a compartment disposed at and extending from the rear end of a writing utensil. To use the stamping equipment, the cap of the writing utensil is attached to the stamp support as a handle and the stamp plate is removed from the compartment. Though the stamp plate can be pressed onto a substrate, it has the drawback of removing the stamp manually. As a result the stamp and the stamp plate can be lost while it is taken out of the compartment and problems can be encountered when the cap not properly fitted thereto.

U.S. Pat. No. 4,606,665 disclosed a second construction including a stamp and stamp pad, respectively mounted on supports. Each of the supports is pivotally articulated at one end about an axis perpendicular to the longitudinal axis of the writing utensil between a position approximately parallel to the longitudinal axis of the writing utensil and a position approximately perpendicular to the longitudinal axis of the writing utensil. With each design, the stamp and stamp pad are rigidly connected to the rear part of the writing utensil even when the writing utensil is in use. This design has the drawbacks that after it has been lifted for use, a pressure must apply on the stamp support in order to print on a substrate. After use, the stamping pad support and the stamp support are manually folded before the covering cap is sleeved over them in order to enclose therein. In addition, since the stamp plate and the stamp pad are very similar to each other, one cannot easily exclude the possibility of confusion that instead of stamp plate, the stamp pad is pressed onto the substrates when the stamping operation is carried out quickly.

SUMMARY OF THE INVENTION

Considering such known writing devices having integral stamping equipment, an object of the present invention is to provide a writing utensil with a stamp plate and a stamping pad so that immediately after the stamp plate and stamp pad have been automatically separated, the stamp plate is ready for use without requiring the user to apply a tremendous pressure thereby enhancing the handling of the stamp plate.

A second object of the present invention is to provide a writing utensil with integral stamping equipment including a stamp plate and a stamping pad of different configuration so that there can not be a confusion even if the stamping operation is carried out in a hurry.

Accordingly, a writing utensil with integral stamping equipment of the present invention includes a stamp pad support extending longitudinally from the rear end of the writing utensil. The stamp pad support has an elongated recessed groove thereon upon which a stamp pad is disposed. A stamp support includes a first end pivotally connected to the rear end of the writing utensil adapted to pivot between a first position approximately parallel to the longitudinal axis of the writing utensil and a second position approximately perpendicular to the longitudinal axis of the same. A stamp plate includes a first side with stamp seal and a projection with a substantial weight centrally provided on a second side of the stamp plate. The projection has two ends, one end of which is pivotally connected to the other end of the stamp support in such a manner that the stamp plate can pivot between a third position parallel to the longitudinal axis of the writing utensil and a fourth position perpendicular to longitudinal axis of the same. A covering cap is slidably mounted on the writing utensil to enclose the stamp pad support, the stamp and the stamp support when they are positioned parallel to the longitudinal axis of the writing utensil and to uncover the stamping equipment by the reverse action.

BRIEF DESCRIPTION OF THE DRAWINGS

Other features and advantages of the present invention will become apparent from the following detailed description considered in connection with the accompanying drawings, which disclose a preferred embodiment of the invention. It is to be understood that the drawings are to be used for the purposes of illustration only and not as a definition of the limits of the invention.

DETAILED DESCRIPTION OF THE PREFERRED EMBODIMENT

Figure 1:
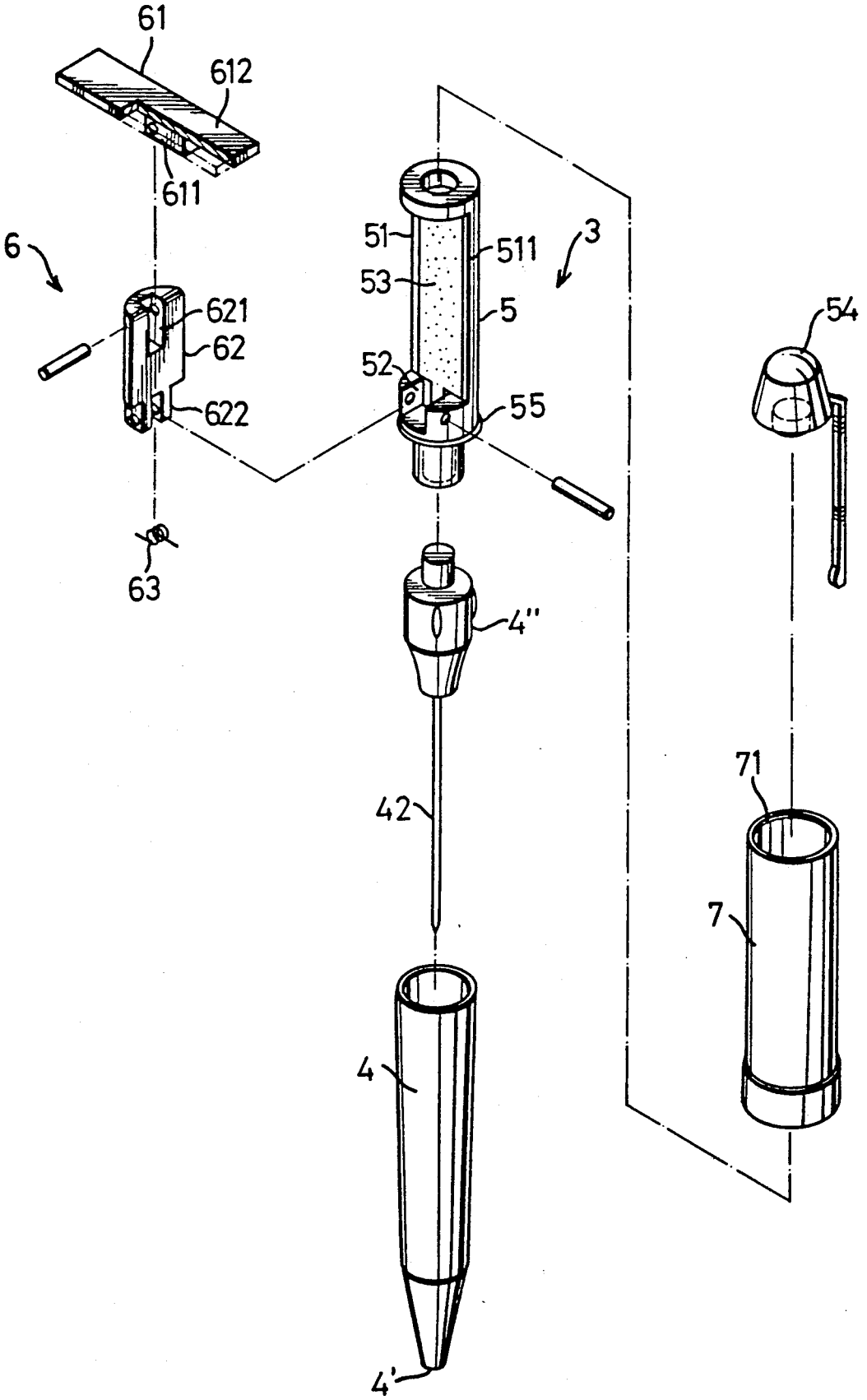
FIG. 1 is an exploded view of a writing utensil according to present invention.
Figure 2:
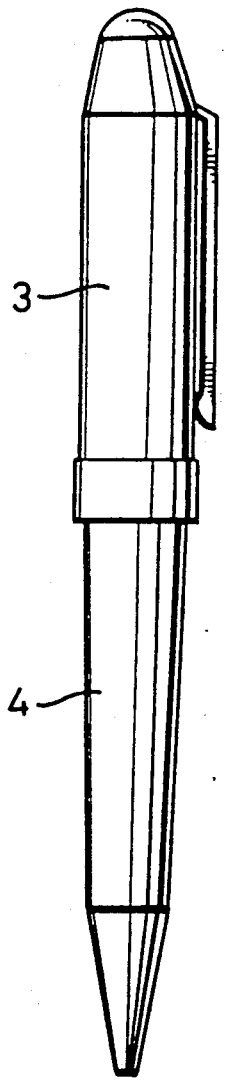
FIG. 2 is a perspective, schematic view of the writing utensil of FIG. 1.

Referring to FIG. 1, a writing utensil with integral stamping equipment of the present invention is shown to comprise a top portion (3) and a lower portion (4) which are interconnected by an intermediate member (4"). The lower portion (4) includes a first portion (4') and has a spring-loaded writing end (42) provided in the same which can be protruded from the first portion (4') for writing purpose and retractable into the same when not in use.

A stamp pad support (5) extends from the intermediate member (4") longitudinally to the axis of the writing utensil, which support includes a recessed groove (51) formed on the same, as shown in FIG. 1. A stamp pad (53) is provided in the recessed groove (51). The stand pad support (5) includes an annular ledge (55) extending outwardly from a first end of said stamp pad support adjacent to the intermediate member (4") of the writing utensil. A clamping element (54) is provided at a second end of the support (5). When a covering cap (7) with an inner projections (71) at a first end of the covering cap, is slidably fitted over the writing utensil, the covering cap (7) can slide between a position where the first end of said covering cap is stopped by the clamping element (54) and another position where the an inner projection (71) of the covering cap is prevented by the annular ledge so that the cap can not disengage from the writing utensil. Thus, the covering cap can enclose and uncover the stamping equipment of the writing utensil, the stamping equipment of which will be described in detail later.

The first end of the stamp pad support (5) is bifurcated to have two prongs (52), so that when one end (622) of the stamp support (62) is pivotally connected to said first end of the stamp pad support (5), a cross-tie can be inserted between the two prongs (52) in order to connect the two supports together. It is important to observe here that the end (622) of the stamp support (62) is also bifurcated so that a torsional spring (63) sleeved through said cross-tie with one end biasing the first end of stamp pad support (5), and the other end biasing the end of said stamp support (62) away from the stamp pad support (5).

Under this condition, the stamp support (62) can move between a first position approximately parallel to the longitudinal axis of the writing utensil and a second position approximately perpendicular to the longitudinal axis of the writing utensil. It is also to be understood that the stamp support (62) can not pivot further away from the second position when it is pivoted from the first to the second position.

The stamp support (62) has a length substantially half the length of the stamp pad support (5) and the other end of the same is also bifurcated. A stamp plate (61) with a stamp seal (612) on one side and a rectangular solid block (611) with a substantial weight, is centrally provided on the other side of the stamp plate. The solid block (611) has two ends, equally spaced from its center of mass, and one end of which is inserted between the bifurcated end of the stamp support (62) and held therebetween by a pin that the stamp plate (61) can pivot about said bifurcated end of the stamp support (62) between a third position approximately parallel to the longitudinal axis of the writing utensil and a fourth position approximately perpendicular to the longitudinal axis of the same. It is important to note that the stamp seal (612) must meet with the stamp pad (53) in the recessed groove of the stamp pad support (5) and the stamp plate (611) can not rotate beyond that fourth position when it is pivoted from the third position to the fourth position. Since the rectangular solid block (611) on the stamp plate (61) has a sufficient weight, one does not need to apply a tremendous pressure while printing said seal on a substrate. This is one feature of the present invention.

Because of its unusual configuration, the stamp support (62) is always pushed to be in a perpendicular position wherein the stamp plate (61) is in a parallel position ( see in FIG. 3 ) once the covering cap is pushed over to uncover it. Under this condition, the stamp plate (61) is ready for use. There can not be a confusion of using stamp pad for stamp seal. This is the second feature of the present invention.

Figure 4:
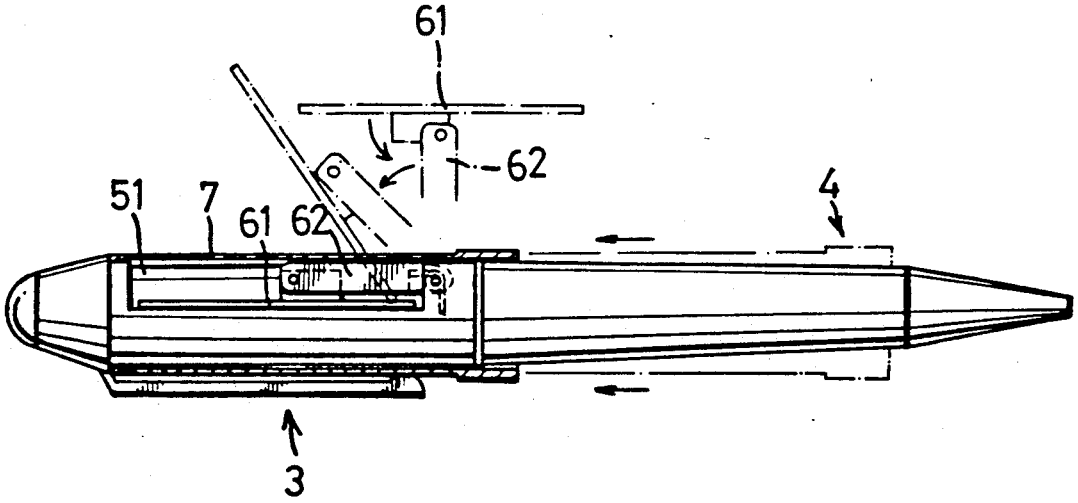
FIG. 4 shows the stamping equipment of the writing utensil of FIG. 1 in a stored position.

To store the stamping equipment, one only needs to hold the writing utensil as shown in FIG. 4, and slide the covering cap (7) in the arrow direction, shown by perforated lines. At this condition, a slight push on the stamp support (62) by the covering cap (7) will fold the stamp plate (61) inwardly of the stamp support (62) and later inside of the recessed groove (51) of the stamp pad support (5) due to the solid block's (61) weight shown by two arrow in FIG. 4. It is rather obvious from the illustration that no other manual action is needed, as in the previous model, to store the stamping equipment of the present invention. This is the third feature of the present invention.

Figure 3:
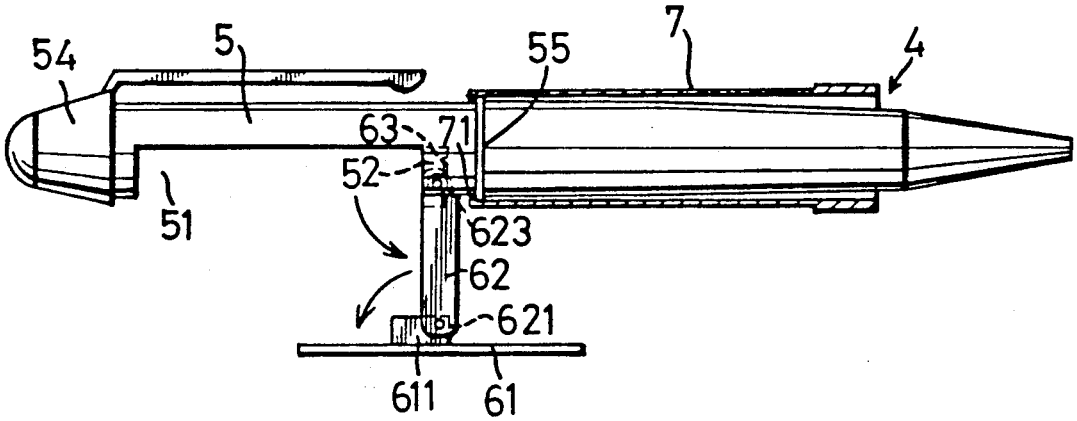
FIG. 3 shows the stamping equipment of the writing utensil of FIG. 1 in use configuration.

Once the covering cap (7) is pushed to be in a position as shown in FIG. 3, the stamp support (62) will be immediately pushed out from the recessed groove (51) of the stamp pad support due to the biasing force of a torsional spring (63) and the weight of the solid block (611) as is already explained above. This is another feature of the present invention.

With the invention thus explained, it is obvious to those skilled in the art that several variations and modifications can be made without departing from the scope and spirit of the present invention. It is therefore intended that these claims be treated only as in the appended claims.

I claim:

1. A writing utensil including a writing end and a rear end, said writing utensil comprising:

an elongated stamp pad support for supporting a stamp pad, connected to said rear end axially of said writing utensil, said stamp pad support having a first end including an annular ledge extending radially and outwardly from said first end formed adjacent to said rear end of said writing utensil, and a second end having a clamping element connected thereto;

an elongated stamp support having a first end connected to said first end of said stamp pad support and pivotable between a first position parallel to the longitudinal axis of said writing utensil and a second position perpendicular to the longitudinal axis of said writing utensil, and a second end;

means for preventing said elongated stamp support from pivoting further away from said second position when said stamp support is pivoted from said first position to said second position;

an elongated stamp plate having a stamp seal on a first face and a second face opposite to said first face, centrally connected to said second end of said stamp support so that said elongated stamp plate can pivot about said second end of said stamp support between a third position parallel to the longitudinal axis of said writing utensil and a fourth position perpendicular to the longitudinal axis of said writing utensil;

means for preventing said elongated stamp plate from pivoting further away from said fourth position, when said elongated stamp plate is pivoted from said third position to said fourth position;

a covering cap having means for engaging said annular ledge and said clamping element to prevent said covering cap from disengaging from said writing utensil, said covering cap being slidably mounted to said writing utensil between a fifth position where a first end of said covering cap is thrusted by said clamping element and a sixth position where said first end of said covering cap engages said engaging means to prevent said covering cap from disengaging from said writing utensil, said covering cap enclosing said stamp pad support, said stamp support and said stamp plate when said covering cap is at said fifth position and said stamp support and said stamp plate are respectively at said first and fourth position, said stamp support and said stamp plate being capable of pivoting to said second and said third position when said covering cap is moved from said fifth position to said sixth position.

2. A writing utensil as claimed in claim 1, wherein a torsion spring is disposed between said first end of said elongated stamp pad support and said first end of said elongated stamp support, said torsional spring biasing said first end of said elongated stamp support to move toward said second position.

3. A writing utensil as claimed in claim 1, wherein said stamp plate further has a counter weight mounted on said second face of the same, so that the center of mass co-defined by said counter weight and said stamp plate is located on a half side of said stamp plate which closes said stamp support when said stamp plate is moved from said fourth position towards said third position.

* * * * *